US006149794A

United States Patent [19]

Heimann et al.

[11] Patent Number: 6,149,794

[45] **Date of Patent: *Nov. 21, 2000**

[54] METHOD FOR CATHODICALLY TREATING AN ELECTRICALLY CONDUCTIVE ZINC SURFACE

[75] Inventors: Robert L. Heimann; William M. Dalton; John Hahn; David M. Price, all of Moberly, Mo.

[73] Assignee: Elisha Technologies Co LLC, Moberly, Mo.

[ * ] Notice: This patent issued on a continued prosecution application filed under 37 CFR 1.53(d), and is subject to the twenty year patent term provisions of 35 U.S.C. 154(a)(2).

[21] Appl. No.: 09/016,250

[22] Filed: Jan. 30, 1998

Related U.S. Application Data

[60] Provisional application No. 60/036,024, Jan. 31, 1997, and provisional application No. 60/045,446, May 2, 1997.

[51] Int. Cl.[7] ..... C25D 9/00

[52] U.S. Cl. ..... 205/316; 205/320

[58] Field of Search ..... 205/320, 321, 205/322, 323, 333, 735, 316

[56] References Cited

U.S. PATENT DOCUMENTS

| | | | |
|---|---|---|---|
| 1,129,320 | 2/1915 | Vail et al. . | |
| 1,289,215 | 12/1918 | MacGahan . | |
| 1,366,305 | 1/1921 | Whyte . | |
| 1,540,766 | 6/1925 | Daniels et al. . | |
| 1,744,116 | 1/1930 | Hannen et al. . | |
| 1,844,670 | 2/1932 | Manson . | |
| 1,909,365 | 5/1933 | Knabner . | |
| 1,912,175 | 5/1933 | Blough et al. . | |
| 1,946,146 | 2/1934 | Kiefer et al. . | |
| 2,462,763 | 2/1949 | Nightingall . | |
| 2,475,330 | 7/1949 | Levy . | |
| 2,495,457 | 1/1950 | Jacobs . | |
| 2,512,563 | 6/1950 | De Long . | |
| 2,539,455 | 1/1951 | Mazia . | |
| 2,641,556 | 6/1953 | Robinson . | |
| 2,780,591 | 2/1957 | Frey . | |
| 2,855,328 | 10/1958 | Long . | |
| 3,224,927 | 12/1965 | Brown et al. . | |
| 3,301,701 | 1/1967 | Baker et al. . | |
| 3,444,007 | 5/1969 | Maurer et al. . | |
| 3,515,600 | 6/1970 | Jones et al. . | |
| 3,658,662 | 4/1972 | Casson, Jr. et al. . | |
| 3,663,277 | 5/1972 | Koepp et al. . | |
| 3,796,608 | 3/1974 | Pearlman . | |
| 3,839,256 | 10/1974 | Parkinson . | |
| 3,920,468 | 11/1975 | Brown et al. | 205/316 |
| 4,059,658 | 11/1977 | Shoup et al. . | |
| 4,101,692 | 7/1978 | Lomasney et al. . | |
| 4,150,191 | 4/1979 | Karki . | |
| 4,222,779 | 9/1980 | Bengali et al. . | |
| 4,240,838 | 12/1980 | Blasko et al. . | |
| 4,288,252 | 9/1981 | Neely . | |
| 4,412,863 | 11/1983 | Neely, Jr. . | |
| 4,425,166 | 1/1984 | Pavlik et al. . | |
| 4,478,905 | 10/1984 | Neely, Jr. . | |
| 4,599,371 | 7/1986 | Loch et al. | 523/402 |
| 5,221,371 | 6/1993 | Miller . | |
| 5,338,434 | 8/1994 | Ruhle et al. | 205/229 |
| 5,352,342 | 10/1994 | Riffe . | |
| 5,433,976 | 7/1995 | Van Ooij et al. | 427/327 |
| 5,478,451 | 12/1995 | Riffe . | |
| 5,498,284 | 3/1996 | Neely, Jr. . | |
| 5,603,818 | 2/1997 | Brent . | |
| 5,616,229 | 4/1997 | Samsonov et al. . | |
| 5,653,823 | 8/1997 | McMillen et al. . | |
| 5,658,697 | 8/1997 | Lin . | |
| 5,660,707 | 8/1997 | Shastry et al. . | |
| 5,660,709 | 8/1997 | Bauer et al. . | |
| 5,672,390 | 9/1997 | Crews, IV et al. . | |
| 5,674,371 | 10/1997 | Patel . | |
| 5,674,790 | 10/1997 | Araujo . | |
| 5,681,378 | 10/1997 | Kerherve . | |
| 5,681,658 | 10/1997 | Anderson et al. . | |
| 5,683,522 | 11/1997 | Joesten . | |
| 5,683,567 | 11/1997 | Shimamune et al. . | |
| 5,683,568 | 11/1997 | Harris et al. . | |
| 5,683,751 | 11/1997 | Derule et al. . | |
| 5,743,953 | 4/1998 | Twardowski et al. . | |
| 5,750,085 | 5/1998 | Yamada et al. . | |
| 5,750,188 | 5/1998 | Menu . | |
| 5,766,564 | 6/1998 | Tijburg et al. . | |
| 5,807,428 | 9/1998 | Bose et al. . | |
| 5,824,366 | 10/1998 | Bose et al. . | |
| 5,868,819 | 2/1999 | Guhde et al. . | |
| 5,900,136 | 5/1999 | Gotsu et al. . | |
| 5,906,971 | 5/1999 | Lark . | |
| 5,916,516 | 6/1999 | Kolb . | |

FOREIGN PATENT DOCUMENTS

| | | |
|---|---|---|
| 05255889 | 10/1993 | Japan . |
| H5-255889 | 10/1993 | Japan . |
| 498485 | 2/1939 | United Kingdom . |
| WO 97/03231 | 1/1997 | WIPO . |

OTHER PUBLICATIONS

ASM Handobook, 1994, pp. 4, 7, 8 and 10. No Month Available.

Brown et al.—Silicates as Cleaners in the Production of Tin Plate II. Influence of Batch Anneal, *Plating*, Oct. 1971.

1979, pp. 83–85, 161–163 The Chemistry of Silica—Solubility, Polymerization, Colloid and Surface Properties, and Biochemistry —Ralph K. Iler—John Wiley & Sons.

1952, pp. 152, 231, and 284 Soluble Silicates Their Properties and Uses—vol. 2: Technology—James G. Vail, D.Sc-.–Copyright 1952.

ISFEC 92 Conference, Sep. 1992 Watson, et al.—The Electrodeposition of Zinc Chromium Alloys and the Formation of Conversion Coatings Without Use of Chromate Solutions.

*Primary Examiner*—Kathryn Gorgos
*Assistant Examiner*—Wesley A. Nicolas
*Attorney, Agent, or Firm*—Michael K. Boyer

[57] ABSTRACT

The disclosure relates to a process for forming a deposit on the surface of a metallic or conductive surface. The process employs an electrolytic process to deposit a mineral containing coating or film upon a metallic or conductive surface.

20 Claims, 1 Drawing Sheet

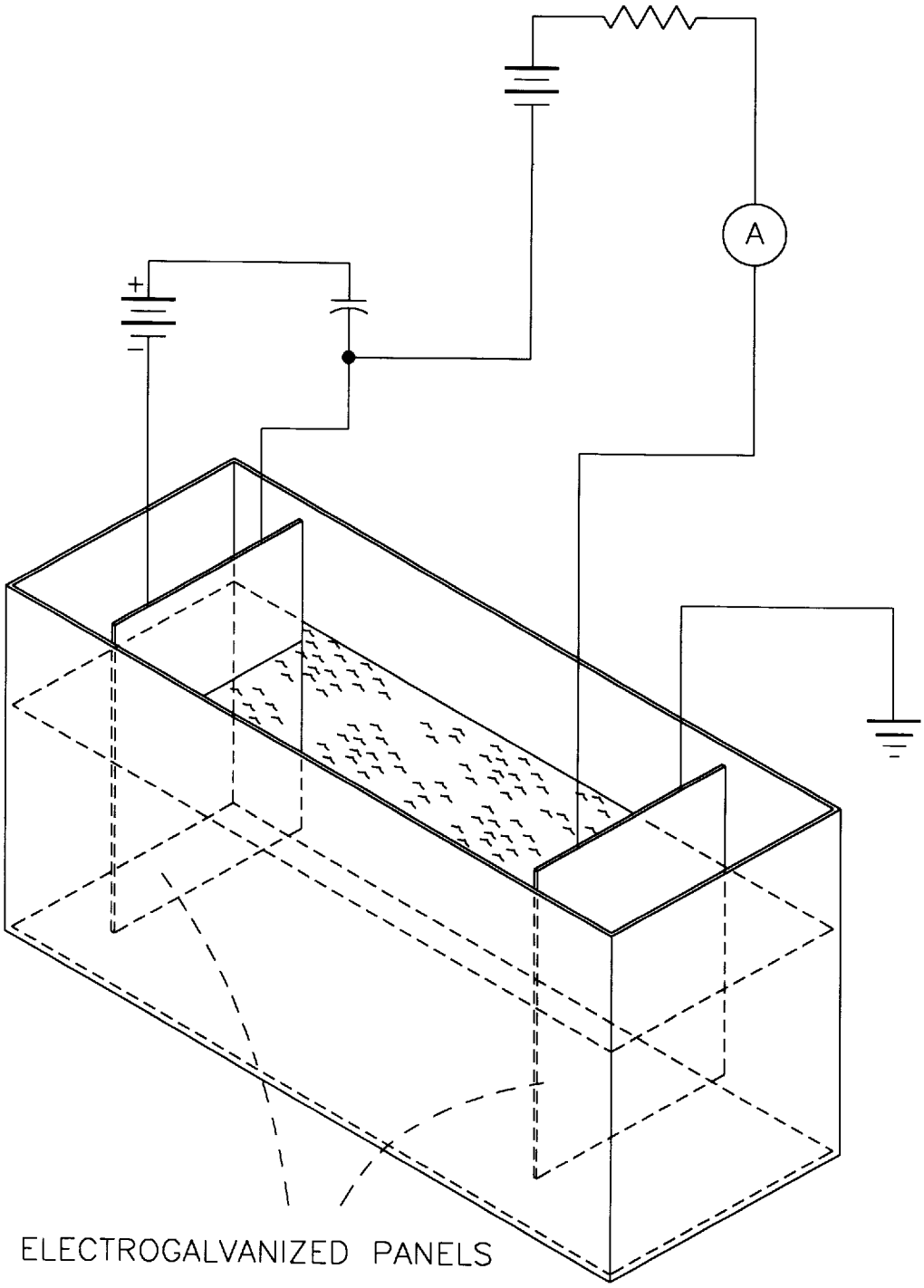
A
+
−
ELECTROGALVANIZED PANELS

METHOD FOR CATHODICALLY TREATING AN ELECTRICALLY CONDUCTIVE ZINC SURFACE

The subject matter of this invention claims benefit under 35 U.S.C. 111(a), 35 U.S.C. 119(e) and 35 U.S.C. 120 of U.S. Provisional Patent Application Serial Nos. 60/036,024, filed on Jan. 31, 1997 and Ser. No. 60/045,446, filed on May 2, 1997 and entitled "Non-Equilibrium Enhanced Mineral Deposition". The disclosure of the previously filed provisional patent applications is hereby incorporated by reference.

FIELD OF THE INVENTION

The instant invention relates to a process for forming a deposit on the surface of a metallic or conductive surface. The process employs an electrolytic process to deposit a mineral containing coating or film upon a metallic or conductive surface.

BACKGROUND OF THE INVENTION

Silicates have been used in electrocleaning operations to clean steel, tin, among other surfaces. Electrocleaning is typically employed as a cleaning step prior to an electroplating operation. Using "Silicates As Cleaners In The Production of Tinplate" is described by L. J. Brown in February 1966 edition of Plating.

Processes for electrolytically forming a protective layer or film by using an anodic method are disclosed by U.S. Pat. No. 3,658,662 (Casson, Jr. et al.), and United Kingdom Patent No. 498,485; both of which are hereby incorporated by reference.

U.S. Pat. No. 5,352,342 to Riffe, which issued on Oct. 4, 1994 and is entitled "Method And Apparatus For Preventing Corrosion Of Metal Structures" that describes using electromotive forces upon a zinc solvent containing paint.

SUMMARY OF THE INVENTION

The instant invention solves problems associated with conventional practices by providing a cathodic method for forming a protective layer upon a metallic substrate. The cathodic method is normally conducted by immersing a electrically conductive substrate into a silicate containing bath wherein a current is pased through the bath and the substrate is the cathode. A mineral layer comprising an amorphous matrix surrounding or incorporating metal silicate crystals forms upon the substrate. The mineral layer imparts improved corrosion resistance, among other properties, to the underlying substrate.

The inventive process is also a marked improvement over conventional methods by obviating the need for solvents or solvent containing systems to form a corrosion resistant layer, i.e., a mineral layer. In contrast, to conventional methods he inventive process is substantially solvent free. By "substantially solvent free" it is meant that less than about 5 wt. %, and normally less than about 1 wt. % volatile organic compounds (V.O.C.s) are present in the electrolytic environment.

In contrast to conventional electrocleaning processes, the instant invention employs silicates in a cathodic process for forming a mineral layer upon the substrate. Conventional electrocleaning processes sought to avoid formation of oxide containing products such as greenalite whereas the instant invention relates to a method for forming silicate containing products, i.e., a mineral.

CROSS REFERENCE TO RELATED PATENTS AND PATENT APPLICATIONS

The subject matter of the instant invention is related to copending and commonly assigned Non-Provisional U.S. patent application Ser. Nos. 08/850,323; 08/850,586; and 09/016,853 (EL001RH-6, EL001RH-7 and EL001RH-8) all currently pending, filed respectively on May 2, 1997 and even date herewith, and 08/791,337 U.S. Pat. No. 5,938,976, in the names of Robert L. Heimann et al., as a continuation in part of Ser. No. 08/634,215 (filed on Apr. 18, 1996), now abandoned, in the names of Robert L. Heimann et al., and entitled "Corrosion Resistant Buffer System for Metal Products", which is a continuation in part of Non-Provisional U.S patent application Ser. No. 08/476,271 (filed on Jun. 7, 1995), now abandoned, in the names of Heimann et al., and corresponding to WIPO Patent Application Publication No. WO 96/12770, which in turn is a continuation in part of Non-Provisional U.S. patent application Ser. No. 08/327,438 (filed on Oct. 21, 1994), now U.S. Pat. No. 5,714,093.

The subject matter of this invention is related to Non-Provisional Patent Application Serial No. 09/016,849, currently pending, filed on even date herewith and entitled "Corrosion Protective Coatings". The subject matter of this invention is also related to Non-Provisional patent application Ser. No. 09/016,462, now U.S. Pat. No. 6,033,495 filed respectively, on even date herewith and Jan. 31, 1997 and entitled "Aqueous Gel Compositions and Use Thereof". The disclosure of the previously identified patents, patent applications and publications is hereby incorporated by reference.

BRIEF DESCRIPTION OF THE DRAWING

FIG. 1 is a schematic drawing of the circuit and apparatus which can be employed for practicing an aspect of the invention.

DETAILED DESCRIPTION

The instant invention relates to a process for depositing or forming a mineral containing coating or film upon a metallic or an electrically conductive surface. The process employs a mineral containing solution e.g., containing soluble mineral components, and utilizes an electrically enhanced method to obtain a mineral coating or film upon a metallic or conductive surface. By "mineral containing coating," it is meant to refer to a relatively thin coating or film which is formed upon a metal or conductive surface wherein at least a portion of the coating or film includes at least one of metal atom containing mineral, e.g., an amorphous phase or matrix surrounding or incorporating crystals comprising a zinc disilicate. Mineral and Mineral Containing are defined in the previously identified Copending and Commonly Assigned Patents and Patent Applications; incorporated by reference. By "electroyltic" or "electrodeposition" or "electrically enhanced", it is meant to refer to an environment created by passing an electrical current through a silicate containing medium while in contact with an electrically conductive substrate wherein the substrate functions as the cathode.

The electroyltic environment can be established in any suitable manner including immersing the substrate, applying a silicate containing coating upon the substrate and thereafter applying an electrical current, among others. The preferred method for establishing the environment will be determined by the size of the substrate, electroplating time, among other parameters known in the electrodeposition art.

The silicate containing medium can be a fluid bath, gel, spray, among other methods for contacting the substrate with the silicate medium. Examples of the silicate medium comprise a bath containing at least one alkali silicate, a gel comprising at least one alkali silicate and a thickener, among others. Normally, the medium comprises a bath of sodium silicate.

The metal surface refers to a metal article as well as a non-metallic or an electrically conductive member having an adhered metal or conductive layer. Examples of suitable metal surfaces comprise at least one member selected from the group consisting of galvanized surfaces, zinc, iron, steel, brass, copper, nickel, tin, aluminum, lead, cadmium, magnesium, alloys thereof, among others. While the inventive process can be employed to coat a wide range of metal surfaces, e.g., copper, aluminum and ferrous metals, the mineral layer can be formed on a non-conductive substrate having at least one surface coated with an electrically conductive material, e.g., a ceramic material encapsulated within a metal. Conductive surfaces can also include carbon or graphite as well as conductive polymers (polyaniline for example).

The mineral coating can enhance the surface characteristics of the metal or conductive surface such as resistance to corrosion, protect carbon (fibers for example) from oxidation and improve bonding strength in composite materials, and reduce the conductivity of conductive polymer surfaces including potential application in sandwich type materials.

In an aspect of the invention, an electrogalvanized panel, e.g., a zinc surface, is coated electrolytically by being placed into an aqueous sodium silicate solution. After being placed into the silicate solution, a mineral coating or film containing silicates is deposited by using low voltage and low current.

In one aspect of the invention, the metal surface, e.g., zinc, steel or lead, has been pretreated. By "pretreated" it is meant to refer to a batch or continuous process for conditioning the metal surface to clean it and condition the surface to facilitate acceptance of the mineral or silicate containing coating e.g., the inventive process can be employed as a step in a continuous process for producing corrosion resistant coil steel. The particular pretreatment will be a function of composition of the metal surface and desired composition of mineral containing coating/film to be formed on the surface. Examples of suitable pretreatments comprise at least one of cleaning, activating, and rinsing. A suitable pretreatment process for steel comprises:

1) 2 minute immersion in a 3:1 dilution of Metal Prep 79 (Parker Amchem),
2) two deionized rinses,
3) 10 second immersion in a pH 14 sodium hydroxide solution,
4) remove excess solution and allow to air dry,
5) 5 minute immersion in a 50% hydrogen peroxide solution,
6) remove excess solution and allow to air dry.

In another aspect of the invention, the metal surface is pretreated by anodically cleaning the surface. Such cleaning can be accomplished by immersing the work piece or substrate into a medium comprising silicates, hydroxides, phosphates and carbonates. By using the work piece as the anode in a DC cell and maintaining a current of 100mA/cm$^2$, this process can generate oxygen gas. The oxygen gas agitates the surface of the workpiece while oxidizing the substrate's surface.

In a further aspect of the invention, the silicate solution is modified to include one or more dopant materials. While the cost and handling characteristics of sodium silicate are desirable, at least one member selected from the group of water soluble salts and oxides of tungsten, molybdenum, chromium, titanium, zircon, vanadium, phosphorus, aluminum, iron, boron, bismuth, gallium, tellurium, germanium, antimony, niobium (also known as columbium), magnesium and manganese, mixtures thereof, among others, and usually, salts and oxides of aluminum and iron can be employed along with or instead of a silicate. The dopant materials can be introduced to the metal or conductive surface in pretreatment steps prior to electrodeposition, in post treatment steps following electrodeposition, and/or by alternating electrolytic dips in solutions of dopants and solutions of silicates if the silicates will not form a stable solution with the water soluble dopants. When sodium silicate is employed as a mineral solution, desirable results can be achieved by using N grade sodium silicate supplied by Philadelphia Quartz (PQ) Corporation. The presence of dopants in the mineral solution can be employed to form tailored mineral containing surfaces upon the metal or conductive surface, e.g, an aqueous sodium silicate solution containing aluminate can be employed to form a layer comprising oxides of silicon and aluminum.

The silicate solution can also be modified by adding water soluble polymers, and the elctrodeposition solution itself can be in the form of a flowable gel consistency. A suitable composition can be obtained in an aqueous composition comprising 3 wt % N-grade Sodium Silicate Solution (PQ Corp), 0.5 wt % Carbopol EZ-2 (BF Goodrich), about 5 to 10 wt. % fumed silica, mixtures thereof, among others . Further, the aqueous silicate solution can be filled with a water dispersible polymer such as polyurethane to electro deposit a mineral-polymer composite coating. The characteristics of the electrodeposition solution can be modified or tailored by using an anode material as a source of ions which can be available for codeposition with the mineral anions and/or one or more dopants. The dopants can be useful for building additional thickness of the electrodeposited mineral layer.

The following sets forth the parameters which may be employed for tailoring the inventive process to obtain a desirable mineral containing coating:

1. Voltage
2. Current Density
3. Apparatus or Cell Design
4. Deposition Time
5. Concentration of the N-grade sodium silicate solution
7. Type and concentration of anions in solution
8. Type and concentration of cations in solution
9. Composition of the anode
10. Composition of the cathode
11. Temperature
12. Pressure
13. Type and Concentration of Surface Active Agents The specific ranges of the parameters above depend on the substrate to be deposited on and the intended composition to be deposited. Items 1, 2, 7, and 8 can be especially effective in tailoring the chemical and physical characteristics of the coating. That is, items 1 and 2 can affect the deposition time and coating thickness whereas items 7 and 8 can be employed for introducing dopants that impart desirable chemical characteristics to the coating. The differing types of anions and cations can comprise at least one member selected from the group consisting of Group I metals, Group II metals, transition and rare earth metal oxides, oxyanions such as mineral, molybdate, phosphate, titanate, boron nitride, silicon carbide, aluminum nitride, silicon nitride, mixtures thereof, among others.

While the above description places particular emphasis upon forming a mineral containing layer upon a metal surface, the inventive process can be combined with or replace conventional metal finishing practices. The inventive mineral layer can be employed to protect a metal finish from corrosion thereby replacing conventional phosphating process, e.g., in the case of automotive metal finishing the inventive process could be utilized instead of phosphates and chromates and prior to coating application e.g., E-Coat. Further, the aforementioned aqueous mineral solution can be replaced with an aqueous polyurethane based solution containing soluble silicates and employed as a replacement for the so-called automotive E-coating and/or powder painting process. Moreover, depending upon the dopants and concentration thereof present in the mineral deposition solution, the inventive process can produce microelectronic films, e.g., on metal or conductive surfaces in order to impart enhanced electrical and corrosion resistance, or to resist ultraviolet light and monotomic oxygen containing environments such as space.

The inventive process can be employed in a virtually unlimited array of end-uses such as in conventional plating operations as well as being adaptable to field service. For example, the inventive mineral containing coating can be employed to fabricate corrosion resistant metal products that conventionally utilize zinc as a protective coating, e.g., automotive bodies and components, grain silos, bridges, among many other end-uses.

The x-ray photoelectron spectroscopy (ESCA) data in the following Examples demonstrate the presence of a unique metal disilicate species within the mineralized layer, e.g., ESCA measures the binding energy of the photoelectrons of the atoms present to determine bonding characteristics.

The following Examples are provided to illustrate certain aspects of the invention and it is understood that such an Example does not limit the scope of the invention as defined in the appended claims.

EXAMPLE 1

The following apparatus and materials were employed in this Example:

Standard Electrogalvanized Test Panels, ACT Laboratories
10% (by weight) N-grade Sodium Mineral solution
12 Volt EverReady® battery
1.5 Volt Ray-O-Vac® Heavy Duty Dry Cell Battery
Triplett RMS Digital Multimeter
30 $\mu$F Capacitor
29.8 k$\Omega$ Resistor A schematic of the circuit and apparatus which were employed for practicing the Example are illustrated in FIG. 1. Referring now to FIG. 1, the aforementioned test panels were contacted with a solution comprising 10% sodium mineral and deionized water. A current was passed through the circuit and solution in the manner illustrated in FIG. 1. The test panels was exposed for 74 hours under ambient environmental conditions. A visual inspection of the panels indicated that a light-grey colored coating or film was deposited upon the test panel.

In order to ascertain the corrosion protection afforded by the mineral containing coating, the coated panels were tested in accordance with ASTM Procedure No. B117. A section of the panels was covered with tape so that only the coated area was exposed and, thereafter, the taped panels were placed into salt spray. For purposes of comparison, the following panels were also tested in accordance with ASTM Procedure No. B 117, 1) Bare Electrogalvanized Panel, and 2) Bare Electrogalvanized Panel soaked for 70 hours in a 10% Sodium Mineral Solution. In addition, bare zinc phosphate coated steel panels(ACT B952, no Parcolene) and bare iron phosphate coated steel panels (B1000, no Parcolene) were subjected to salt spray for reference.

The results of the ASTM Procedure are listed in the Table below:

| Panel Description | Hours in B117 Salt Spray |
|---|---|
| Zinc phosphate coated steel | 1 |
| Iron phosphate coated steel | 1 |
| Standard Bare Electrogalvanize Panel | ≈120 |
| Standard Panel with Sodium Mineral Soak | ≈120 |
| Coated Cathode of the Invention | 240+ |

The above Table illustrates that the instant invention forms a coating or film which imparts markedly improved corrosion resistance. It is also apparent that the process has resulted in a corrosion protective film that lengthens the life of electrogalvanized metal substrates and surfaces.

ESCA analysis was performed on the zinc surface in accordance with conventional techniques and under the following conditions:

Analytical conditions for ESCA:

| | |
|---|---|
| Instrument | Physical Electronics Model 5701 LSci |
| X-ray source | Monochromatic aluminum |
| Source power | 350 watts |
| Analysis region | 2 mm × 0.8 mm |
| Exit angle* | 50° |
| Electron acceptance angle | ±7° |
| Charge neutralization | electron flood gun |
| Charge correction | C—(C,H) in C 1s spectra at 284.6 eV |

*Exit angle is defined as the angle between the sample plane and the electron analyzer lens.

The silicon photoelectron binding energy was used to characterized the nature of the formed species within the mineralized layer that was formed on the cathode. This species was identified as a zinc disilicate modified by the presence of sodium ion by the binding energy of 102.1 eV for the Si(2p) photoelectron.

EXAMPLE 2

This Example illustrates performing the inventive electrodeposition process at an increased voltage and current in comparison to Example 1.

Prior to the electrodeposition, the cathode panel was subjected to preconditioning process:

1) 2 minute immersion in a 3:1 dilution of Metal Prep 79 (Parker Amchem),
2) two deionized rinse,
3) 10 second immersion in a pH 14 sodium hydroxide solution,
4) remove excess solution and allow to air dry,
5) 5 minute immersion in a 50% hydrogen peroxide solution,
6) Blot to remove excess solution and allow to air dry.

A power supply was connected to an electrodeposition cell consisting of a plastic cup containing two standard ACT cold roll steel (clean, unpolished) test panels. One end of the test panel was immersed in a solution consisting of 10% N grade sodium mineral (PQ Corp.) in deionized water. The immersed area (1 side) of each panel was approximately 3 inches by 4 inches (12 sq. in.) for a 1:1 anode to cathode ratio. The panels were connected directly to the DC power supply and a voltage of 6 volts was applied for 1 hour. The resulting current ranged from approximately 0.7–1.9 Amperes. The resultant current density ranged from 0.05–0.16 amps/in$^2$.

After the electrolytic process, the coated panel was allowed to dry at ambient conditions and then evaluated for humidity resistance in accordance with ASTM Test No. D2247 by visually monitoring the corrosion activity until development of red corrosion upon 5% of the panel surface area. The coated test panels lasted 25 hours until the first appearance of red corrosion and 120 hours until 5% red corrosion. In comparison, conventional iron and zinc phosphated steel panels develop first corrosion and 5% red corrosion after 7 hours in ASTM D2247 humidity exposure. The above Examples, therefore, illustrate that the inventive process offers an improvement in corrosion resistance over iron and zinc phosphated steel panels.

EXAMPLE 3

Two lead panels were prepared from commercial lead sheathing and cleaned in 6M HCl for 25 minutes. The cleaned lead panels were subsequently placed in a solution comprising 1 wt. % N-grade sodium silicate (supplied by PQ Corporation).

One lead panel was connected to a DC power supply as the anode and the other was a cathode. A potentional of 20 volts was applied initially to produce a current ranging from 0.9 to 1.3 Amperes. After approximately 75 minutes the panels were removed from the sodium silicate solution and rinsed with deionized water.

ESCA analysis was performed on the lead surface. The silicon photoelectron binding energy was used to characterized the nature of the formed species within the mineralized layer. This species was identified as a lead disilicate modified by the presence of sodium ion by the binding energy of 102.0 eV for the Si(2p) photoelectron.

EXAMPLE 4

This Example demonstrates forming a mineral surface upon an aluminum substrate. Using the same apparatus in Example 1, aluminum coupons (3"×6") were reacted to form the metal silicate surface. Two different alloys of aluminum were used, Al 2024 and Al 7075. Prior to the panels being subjected to the electrolytic process, each panel was prepared using the methods outlined below in Table A. Each panel was washed with reagent alcohol to remove any excessive dirt and oils. The panels were either cleaned with Alumiprep 33, subjected to anodic cleaning or both. Both forms of cleaning are designed to remove excess aluminum oxides. Anodic cleaning was accomplished by placing the working panel as an anode into an aqueous solution containing 5% NaOH, 2.4% $Na_2CO_3$, 2% $Na_2SiO_3$, 0.6% $Na_3PO_4$, and applying a potential to maintain a current density of 100mA/cm$^2$ across the immersed area of the panel for one minute.

Once the panel was cleaned, it was placed in a liter beaker filled with 800 mL of solution. The baths were prepared using deionized water and the contents are shown in the table below. The panel was attached to the negative lead of a DC power supply by a wire while another panel was attached to the positive lead. The two panels were spaced 2 inches apart from each other. The potential was set to the voltage shown on the table and the cell was run for one hour.

TABLE A

| Example | A | B | C | D | E | F | G | H |
|---|---|---|---|---|---|---|---|---|
| Alloy type | 2024 | 2024 | 2024 | 2024 | 7075 | 7075 | 7075 | 7075 |
| Anodic Cleaning | Yes | Yes | No | No | Yes | Yes | No | No |
| Acid Wash | Yes | Yes | Yes | Yes | Yes | Yes | Yes | Yes |
| Bath Solution | | | | | | | | |
| $Na_2SiO_3$ | 1% | 10% | 1% | 10% | 1% | 10% | 1% | 10% |
| $H_2O_2$ | 1% | 0% | 0% | 1% | 1% | 0% | 0% | |
| Potential | 12 V | 18 V | 12 V | 18 V | 12 V | 18 V | 12 V | 18 V |

ESCA was used to analyze the surface of each of the substrates. Every sample measured showed a mixture of silica and metal silicate. Without wishing to be bound by any theory or explanation, it is believed that the metal silicate is a result of the reaction between the metal cations of the surface and the alkali silicates of the coating. It is also believed that the silica is a result of either excess silicates from the reaction or precipitated silica from the coating removal process. The metal silicate is indicated by a Si (2p) binding energy (BE) in the low 102 eV range, typically between 102.1 to 102.3. The silica can be seen by Si(2p) BE between 103.3 to 103.6 eV. The resulting spectra show overlapping peaks, upon deconvolution reveal binding energies in the ranges representative of metal silicate and silica.

EXAMPLE 5

This Example illustrates an alternative to immersion for creating the silicate containing medium.

An aqueous gel made from 5% sodium silicate and 10% fumed silica was used to coat cold rolled steel panels. One panel was washed with reagent alcohol, while the other panel was washed in a phosphoric acid based metal prep, followed by a sodium hydroxide wash and a hydrogen peroxide bath. The apparatus was set up using a DC power supply connecting the positive lead to the steel panel and the negative lead to a platinum wire wrapped with glass wool. This setup was designed to simulate a brush plating operation. The "brush" was immersed in the gel solution to allow for complete saturation. The potential was set for 12V and the gel was painted onto the panel with the brush. As the brush passed over the surface of the panel, hydrogen gas evolution could be seen. The gel was brushed on for five minutes and the panel was then washed with DI water to remove any excess gel and unreacted silicates.

ESCA was used to analyze the surface of each steel panel. ESCA detects the reaction products between the metal substrate and the environment created by the electrolytic process. Every sample measured showed a mixture of silica and metal silicate. The metal silicate is a result of the reaction between the metal cations of the surface and the alkali silicates of the coating. The silica is a result of either excess silicates from the reaction or precipitated silica from the coating removal process. The metal silicate is indicated by a Si (2p) binding energy (BE) in the low 102 eV range, typically between 102.1 to 102.3. The silica can be seen by Si(2p) BE between 103.3 to 103.6 eV. The resulting spectra show overlapping peaks, upon deconvolution reveal binding energies in the ranges representative of metal silicate and silica.

EXAMPLE 6

Using the same apparatus in Example 1, cold rolled steel coupons (ACT laboratories) were reacted to form the metal silicate surface. Prior to the panels being subjected to the electrolytic process, each panel was prepared using the methods outlined below in Table B. Each panel was washed with reagent alcohol to remove any excessive dirt and oils. The panels were either cleaned with Metalprep 79 (Parker Amchem), subjected to anodic cleaning or both. Both forms of cleaning are designed to remove excess metal oxides. Anodic cleaning was accomplished by placing the working panel as an anode into an aqueous solution containing 5% NaOH, 2.4% $Na_2CO_3$, 2% $Na_2SiO_3$, 0.6% $Na_3PO_4$, and applying a potential to maintain a current density of 100mA/$cm^2$ across the immersed area of the panel for one minute.

Once the panel was cleaned, it was placed in a 1 liter beaker filled with 800 mL of solution. The baths were prepared using deionized water and the contents are shown in the table below. The panel was attached to the negative lead of a DC power supply by a wire while another panel was attached to the positive lead. The two panels were spaced 2 inches apart from each other. The potential was set to the voltage shown on the table and the cell was run for one hour.

TABLE B

| Example | AA | BB | CC | DD | EE |
|---|---|---|---|---|---|
| Substrate type | CRS | CRS | CRS | CRS[1] | CRS[2] |
| Anodic Cleaning | No | Yes | No | No | No |
| Acid Wash | Yes | Yes | Yes | No | No |
| Bath Solution | | | | | |
| $Na_2SiO_3$ | 1% | 10% | 1% | — | — |
| Potential (V) | 14–24 | 6 (CV) | 12 V (CV) | — | — |
| Current Density (mA/$cm^2$) | 23 (CC) | 23–10 | 85–48 | — | — |
| B177 | 2 hrs | 1 hr | 1 hr | 0.25 hr | 0.25 hr |

[1]Cold Rolled Steel Control- No treatment was done to this panel.
[2]Cold Rolled Steel with iron phosphate treatment (ACT Laboratories)- No further treatments were performed The electrolytic process was either run as a constant current or constant voltage experiment, designated by the CV or CC symbol in the table. Constant Voltage experiments applied a constant potential to the cell allowing the current to fluctuate while Constant Current experiments held the current by adjusting the potential. Panels were tested for corrosion protection using ASTM B117. Failures were determined at 5% surface coverage of red rust.

ESCA was used to analyze the surface of each of the substrates. ESCA detects the reaction products between the metal substrate and the environment created by the electrolytic process. Every sample measured showed a mixture of silica and metal silicate. The metal silicate is a result of the reaction between the metal cations of the surface and the alkali silicates of the coating. The silica is a result of either excess silicates from the reaction or precipitated silica from the coating removal process. The metal silicate is indicated by a Si (2p) binding energy (BE) in the low 102 eV range, typically between 102.1 to 102.3. The silica can be seen by Si(2p) BE between 103.3 to 103.6 eV. The resulting spectra show overlapping peaks, upon deconvolution reveal binding energies in the ranges representative of metal silicate and silica.

EXAMPLE 7

Using the same apparatus in Example 1, zinc galvanized steel coupons (EZG 60G ACT Laboratories) were reacted to form the metal silicate surface. Prior to the panels being subjected to the electrolytic process, each panel was prepared using the methods outlined below in Table C. Each panel was washed with reagent alcohol to remove any excessive dirt and oils.

Once the panel was cleaned, it was placed in a 1 liter beaker filled with 800 mL of solution. The baths were prepared using deionized water and the contents are shown in the table below. The panel was attached to the negative lead of a DC power supply by a wire while another panel was attached to the positive lead. The two panels were spaced approximately 2 inches apart from each other. The potential was set to the voltage shown on the table and the cell was run for one hour.

TABLE C

| Example | A1 | B2 | C3 | D5 |
|---|---|---|---|---|
| Substrate type | GS | GS | GS | GS[1] |
| Bath Solution $Na_2SiO_3$ | 10% | 1% | 10% | — |
| Potential (V) | 6 (CV) | 10 (CV) | 18 (CV) | — |
| Current Density (mA/$cm^2$) | 22-3 | 7-3 | 142-3 | — |
| B177 | 336 hrs | 224 hrs | 216 hrs | 96 hrs |

[1]Galvanized Steel Control- No treatment was done to this panel.

Panels were tested for corrosion protection using ASTM B117. Failures were determined at 5% surface coverage of red rust.

ESCA was used to analyze the surface of each of the substrates. ESCA detects the reaction products between the metal substrate and the environment created by the electrolytic process. Every sample measured showed a mixture of silica and metal silicate. The metal silicate is a result of the reaction between the metal cations of the surface and the alkali silicates of the coating. The silica is a result of either excess silicates from the reaction or precipitated silica from the coating removal process. The metal silicate is indicated by a Si (2p) binding energy (BE) in the low 102 eV range, typically between 102.1 to 102.3. The silica can be seen by Si(2p) BE between 103.3 to 103.6 eV. The resulting spectra show overlapping peaks, upon deconvolution reveal binding energies in the ranges representative of metal silicate and silica.

EXAMPLE 8

Using the same apparatus in Example 1, copper coupons (C110 Hard, Fullerton Metals) were reacted to form the metal silicate surface. Prior to the panels being subjected to the electrolytic process, each panel was prepared using the methods outlined below in Table D. Each panel was washed with reagent alcohol to remove any excessive dirt and oils.

Once the panel was cleaned, it was placed in a 1 liter beaker filled with 800 mL of solution. The baths were prepared using deionized water and the contents are shown in the table below. The panel was attached to the negative lead of a DC power supply by a wire while another panel was attached to the positive lead. The two panels were spaced 2 inches apart from each other. The potential was set to the voltage shown on the table and the cell was run for one hour.

TABLE D

| Example | AA1 | BB2 | CC3 | DD4 | EE5 |
|---|---|---|---|---|---|
| Substrate type | Cu | Cu | Cu | Cu | Cu[1] |
| Bath Solution $Na_2SiO_3$ | 10% | 10% | 1% | 1% | — |
| Potential (V) | 12 (CV) | 6 (CV) | 6 (CV) | 36 (CV) | — |
| Current Density ($mA/cm^2$) | 40-17 | 19-9 | 4-1 | 36-10 | — |
| B117 | 11 hrs | 11 hrs | 5 hrs | 5 hrs | 2 hrs |

[1]Copper Control- No treatment was done to this panel.

Panels were tested for corrosion protection using ASTM B117. Failures were determined by the presence of copper oxide which was indicated by the appearance of a dull haze over the surface.

ESCA was used to analyze the surface of each of the substrates. ESCA allows us to examine the reaction products between the metal substrate and the environment set up from the electrolytic process. Every sample measured showed a mixture of silica and metal silicate. The metal silicate is a result of the reaction between the metal cations of the surface and the alkali silicates of the coating. The silica is a result of either excess silicates from the reaction or precipitated silica from the coating removal process. The metal silicate is indicated by a Si (2p) binding energy (BE) in the low 102 eV range, typically between 102.1 to 102.3. The silica can be seen by Si(2p) BE between 103.3 to 103.6 eV. The resulting spectra show overlapping peaks, upon deconvolution reveal binding energies in the ranges representative of metal silicate and silica.

The following is claimed:

1. An electrically enhanced method for treating a zinc containing metal surface comprising:

contacting the metal surface with a medium comprising a combination comprising water and greater than 2 wt. % of at least one water soluble silicate, establishing an electroyltic environment, wherein the metal surface is employed as a cathode, at a rate and period of time sufficient for the surface to form a layer upon the surface.

2. A method for improving the corrosion resistance of an electrically conductive zinc containing surface comprising:

anodically cleaning the surface, contacting the surface with a medium wherein said medium comprises a combination comprising water and at least one water soluble alkali silicate, establishing an electroylic environment wherein said surface is employed as a cathode to form a layer having improved corrosion resistance in comparison to the surface.

3. The method of claim 2 wherein the anodic cleaning is conducted in an environment having a basic pII.

4. The method of claim 3 wherein the environment comprises at least one member chosen from the group of hydroxides, phosphates and carbonates.

5. A cathodic method for improving the corrosion resistance of a zinc containing metal surface comprising:

exposing the metal surface to an aqueous silicate containing medium, establshing an electrolytic environment wherein the metal surface is employed as a cathode, passing a current through the silicate medium and the metal surface for a period of time and under conditions sufficient to form a corrosion resistant mineral surface upon the metal surface.

6. The method of claim 5 wherein the corrosion resistant mineral surface comprises a reaction product formed between the metal surface and the silicate.

7. The method of claim 6 wherein the corrosion resistant mineral surface comprises an amorphous metal silicate.

8. A cathodic method for treating a zinc containing metal surface comprising:

preparing a medium wherein said medium comprises a combination comprising water and at least one water soluble silicate, establishing an electrolytic environment within the medium wherein the metal surface is employed as a cathode, exposing at least a portion of the metal surface to the medium for a period of time and under conditions sufficient to cause an interaction between at least a portion of the medium and the metal surface;

recovering the treated containing metal surface.

9. The method of any one of claims 1, 2, 5 or 8 wherein the medium comprises sodium silicate.

10. The method of any one of claims 1, 5 or 8 wherein the zinc containing metal surface comprises at least one galvanized member selected from the group consisting of iron, iron alloys and steel.

11. The method of any one of claims 1, 2, 5 or 8 wherein the silicate containing medium further comprises at least one dopant selected from the group consisting of water soluble salts and oxides of tungsten, molybdenum, chromium, titanium, zirconium, vanadium, phosphorus, aluminum, iron, boron, bismuth, gallium, tellurium, germanium, antimony, niobium, magnesium and manganese, and salts and oxides of aluminum and iron.

12. The method of claim 11 wherein the dopant comprises iron.

13. The method of any one of claims 2, 5, or 8 wherein the medium comprises at least 3 wt. % silicate.

14. The method of any one of claims 1, 2, 5 or 8 wherein the silicate containing medium further comprises silica.

15. The method of any one of claims 1, 5 or 8 wherein the metal surface comprises a galvanized surface.

16. The method of any one of claims 1, 2, or 8 further comprising anodically cleaning the metal surface prior to said exposing.

17. The method of any one of claims 1, 2, 5 or 8 wherein said silicate containing medium further comprises a water dispersible polymer.

18. The method of any one of claims 1, 2, 5 or 8 wherein said silicate containing medium further comprises at least one member selected from the group consisting of boron nitride, silicon carbide and aluminum nitride.

19. The method of any one of claims 1, 2, 5 or 8 wherein the silicate containing medium comprises at least 10 wt. % sodium silicate.

20. The method of any of claims 1, 2, 5 or 8 wherein the the medium is substantially solvent free.

* * * * *